US006347764B1

(12) United States Patent
Brandon et al.

(10) Patent No.: US 6,347,764 B1
(45) Date of Patent: Feb. 19, 2002

(54) GUN HARDENED, ROTARY WINGED, GLIDE AND DESCENT DEVICE

(75) Inventors: Fred J. Brandon, Aberdeen; Michael S. L. Hollis, Abingdon, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/710,736

(22) Filed: Nov. 13, 2000

(51) Int. Cl.[7] ..... B64C 27/08
(52) U.S. Cl. ..... 244/17.11; 102/388; 244/49
(58) Field of Search ..... 244/17.11, 17.23, 244/190, 49, 3.27, 17.19, 17.21; 102/385, 386, 388

(56) References Cited

U.S. PATENT DOCUMENTS 3,643,599 A * 2/1972 Hubich
4,296,894 A * 10/1981 Schnabele et al.
4,410,151 A * 10/1983 Hoppner et al.
4,471,923 A * 9/1984 Hoppner et al.
5,224,826 A * 7/1993 Hall et al.
6,119,976 A * 9/2000 Rogers

* cited by examiner

*Primary Examiner*—Charles T. Jordan
*Assistant Examiner*—Tien Dinh
(74) *Attorney, Agent, or Firm*—Paul S. Clohan, Jr.; William V. Adams

(57) ABSTRACT

A payload carrying device which is inserted into a remote area of interest by means of a projectile carrier to obtain data, or the like, from the remote area. The device has counter rotating main blades as well as tail blades carried on a tail rotor. The particular payload is carried in a canister which may also include a power source, a command and control unit and a motor, if hover or lateral flight is desired. The pitch of the tail blades is variable as well as their orientation around an axis, the combination of which generates a thrust vector in a particular direction for controlled lateral flight.

13 Claims, 9 Drawing Sheets

GUN HARDENED, ROTARY WINGED, GLIDE AND DESCENT DEVICE

STATEMENT OF GOVERNMENT INTEREST

The invention described herein may be manufactured and used by or for the Government of the United States of America for government purposes without the payment of any royalties therefor.

BACKGROUND OF THE INVENTION

1. Field of the Invention

Military and civilian organizations have need of small, rugged, and low-cost glide and descent devices to carry sensor packages to obtain information and data in areas beyond their normal line-of-sight. These devices will carry various sensors: optical, audio, chemical, and biological, by way of example. A sensor suite can be tailored to gather specific information dependent upon the scenario. Possible scenarios are activities related to movement of personnel, vehicles, crowd control; atmospheric conditions; building, brush and forest fires progress; and agricultural crop conditions for pest and disease evaluation and control.

The present invention represents an enhanced state-of-the-art concept to provide a low cost, gun/mortar/rocket launched, quick deployable, controlled flight device for carrying a large variety of sensor devices into hazardous and non-hazardous areas for the purpose of data and information gathering and documentation. The device can fly in two modes. The first mode is unpowered, that is to fly as an autogyro. The second mode is powered flight using a power source to drive the rotating blades to provide lift for hover and ascent like a helicopter.

2. Description of Related Art

Typically gun launched payloads that require controlled descent (rate of fall) after ejection from the parent carrier (flight projectile) employ retardation devices such as parachutes, parafoils, ram-air devices or aircraft like devices such as folded fixed wing gliders. Parachutes, parafoils and ram-air devices are for the most part unguided and drift with the air currents as they descend with little or no means of steering. Aircraft devices may have onboard radio control units for guidance and control, but they depend on forward velocity to generate lift to maintain flight.

SUMMARY OF THE INVENTION

The device of the present invention is designed to withstand the high acceleration and spin rate environment of cannon and mortar launch systems. Maximum acceleration levels are 15,000 times the earth's gravity with angular rates as high as 150,000 rad/sec$^2$ for an artillery cannon launch. The invention must also withstand the spin rate of as much as 300 Hz. The device must also survive expulsion loads when ejected from the carrier body, as well as the initial air loads.

In order to fit into the cylindrical cavity of a projectile carrier body, a main rotor blade assembly and tail rotor assembly are designed to fold into a compact package. At a predetermined time the device is explosively expelled from the flight projectile and automatically unfolds and deploys to begin guided descent. The folded main rotor blades also serve as a canister to provide structural integrity and protection for the invention during launch and expulsion.

The present invention, not unlike existing rotary winged aircraft such as helicopters, obtains lift from the rotating main rotor blades. They are capable of controlled descent, hover and vertical ascent through use of these rotating blades and vertical flight control. Thus, forward velocity of the device is not required to maintain flight. The use of flight control and avionics may be required, and can be accomplished through the use of a radio control system or an auto pilot system, by way of example.

For the invention, the use of counter-rotating blades provides a means of roll torque control that must be provided by a tail rotor in existing systems. That is, the roll torque from each set of blades is canceled by the opposing rotation of the counter rotating blade system. These features are well known and have previously been demonstrated. Therefore, a tail rotor system is used in the present invention to provide horizontal directional control. The tail rotor system is designed to pivot about a tail boom to point the device and to control the direction of the down thrust flow from the main rotor blades to achieve horizontal translation, i.e., forward, rearward and sideways flight.

Some unique features of the present invention are in the characteristic of the folded design and mechanisms used to achieve the compactness, the simple blade pitch control mechanism used to achieve vertical flight controlled-descent (during unpowered flight) and hover and ascent (during powered flight), the tail rotor thrust control system for direction flight control, and the tail rotor pivot mechanism used to control the main rotor blade down wash thrust angle to achieve horizontal flight direction control.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
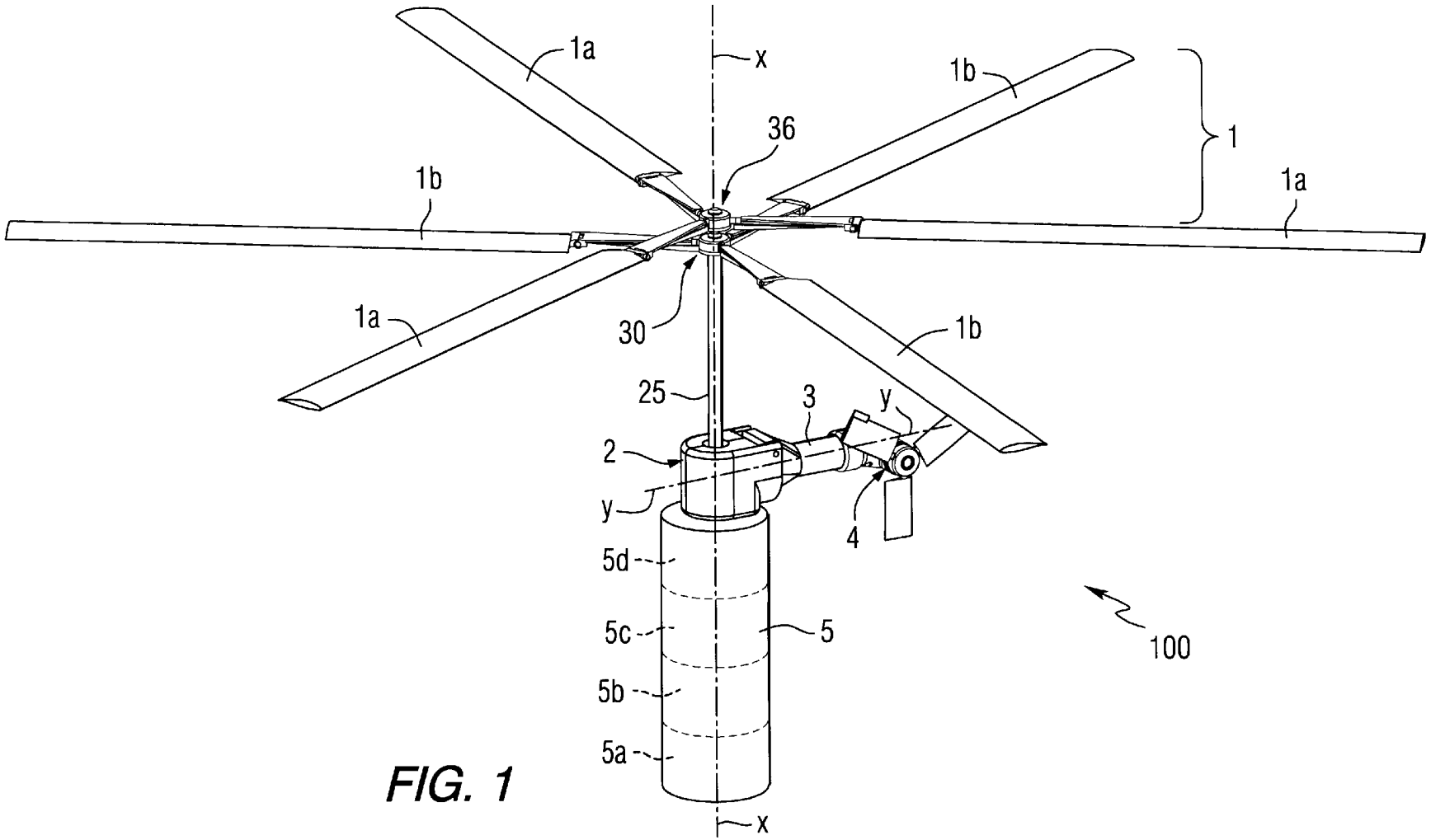
FIG. 1 is a view showing the invention as it would be fully deployed in free flight.

In the drawings, which are not necessarily to scale, like or corresponding parts are denoted by like or corresponding reference numerals.

The present invention adopts the aforementioned principles into a compact, gun hardened, controlled flight device that can withstand the harsh launch environment, be able to be quickly deployed, have controlled flight, provide space for a large number of sensor devices and survive and function in a hostile atmospheric environment.

FIG. 1 illustrates the device (100) in the fully deployed free-flight state. Shown in the figure are: (1) the main rotor blades assembly comprised of coaxial upper rotor blades (1*a*) and lower rotor blades (1*b*), (2) transfer case assembly, (3) tail boom assembly, (4) tail rotor assembly and (5) payload and flight control package canister. By way of example, this canister (5) may include a payload unit (5*a*) comprised of one or more sensors, including, if required, GPS and/or inertial navigation. The canister also includes an electronics unit (5*b*) for command, communication and control, a power unit (5*c*) and a motor unit (5*d*), if powered flight is utilized.

The canister (5) and rotor shaft (25) are colinear and are concentric about, and extend along a device axis X. Similarly, the tail boom (3) is concentric about, and extends along a tail boom axis Y. When the device is fully deployed, axis Y is perpendicular to axis X.

Aerodynamic lift for the invention is created through the counter rotating blade system (1). This system is composed of the upper main rotor blade assembly (36) connected to the upper main rotor shaft (34) (not seen in this view) that passes through the center of the lower main rotor shaft (25) which is connected to lower main rotor blade assembly (30). The upper and lower rotor shafts are connected to the transfer case assembly (2), which is used to control the rotation and synchronization of the counter rotating blades.

Figure 2:
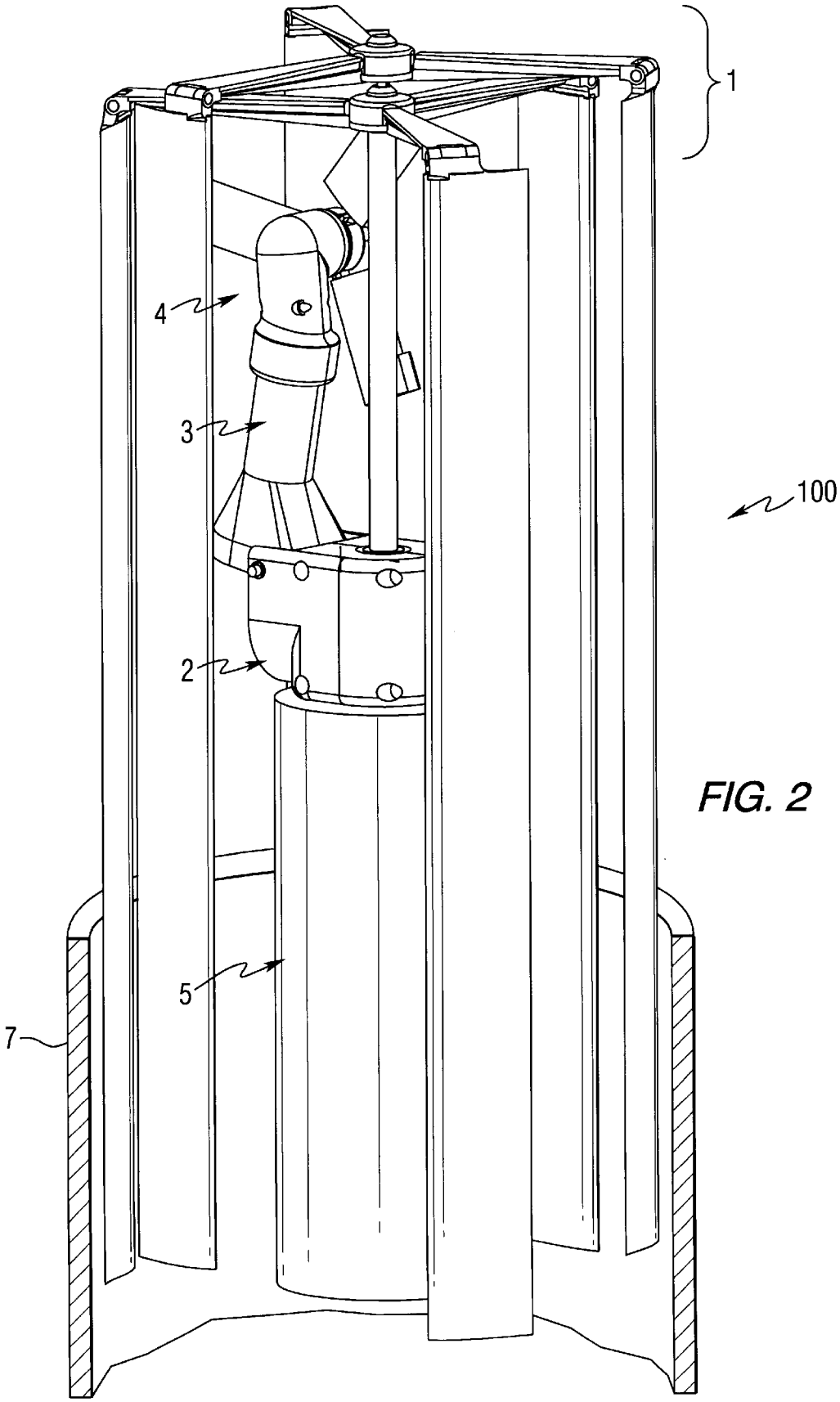
FIG. 2 is a view showing the invention as it would be fully folded and stowed and ready to be inserted into the cylindrical cavity of the carrier.

FIG. 2 illustrates the compact configuration of device (100) in a stowed condition, with the main rotor blade assembly (1) folded down and the tail boom assembly (3) folded up, to be essentially parallel with axis X. The folded compact configuration shows how the device would be inserted into the cylindrical cavity of a carrier, flight projectile (7), a portion of which is illustrated. Torque springs (not shown) in the main rotor blade assemblies and the tail boom assembly are used to assist the unfolding of the blades (1) and the tail boom (3) from the folded configuration.

Figure 3:
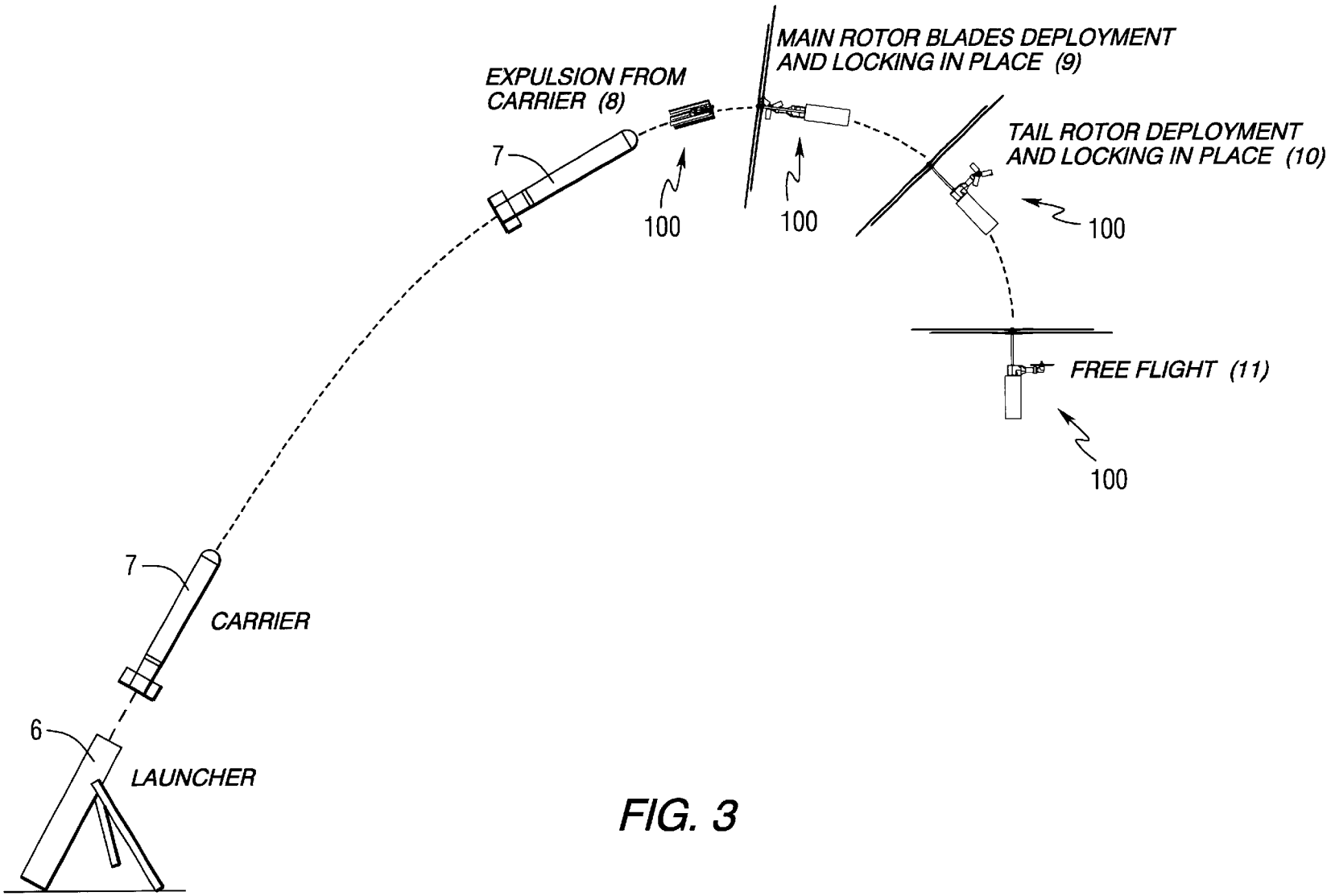
FIG. 3 is a schematic of a scenario showing the sequence of operation for the invention.

FIG. 3 shows a typical launch and flight scenario for the device (100); (6) launcher, (7) device carrier, (8) device expulsion from carrier (achieved through use of standard artillery projectile expulsion system), (9) main rotor deployment and locked in place, (10) tail rotor deployment and locked in place and (11) device in free flight in an area above a remote location of interest.

Figure 4:
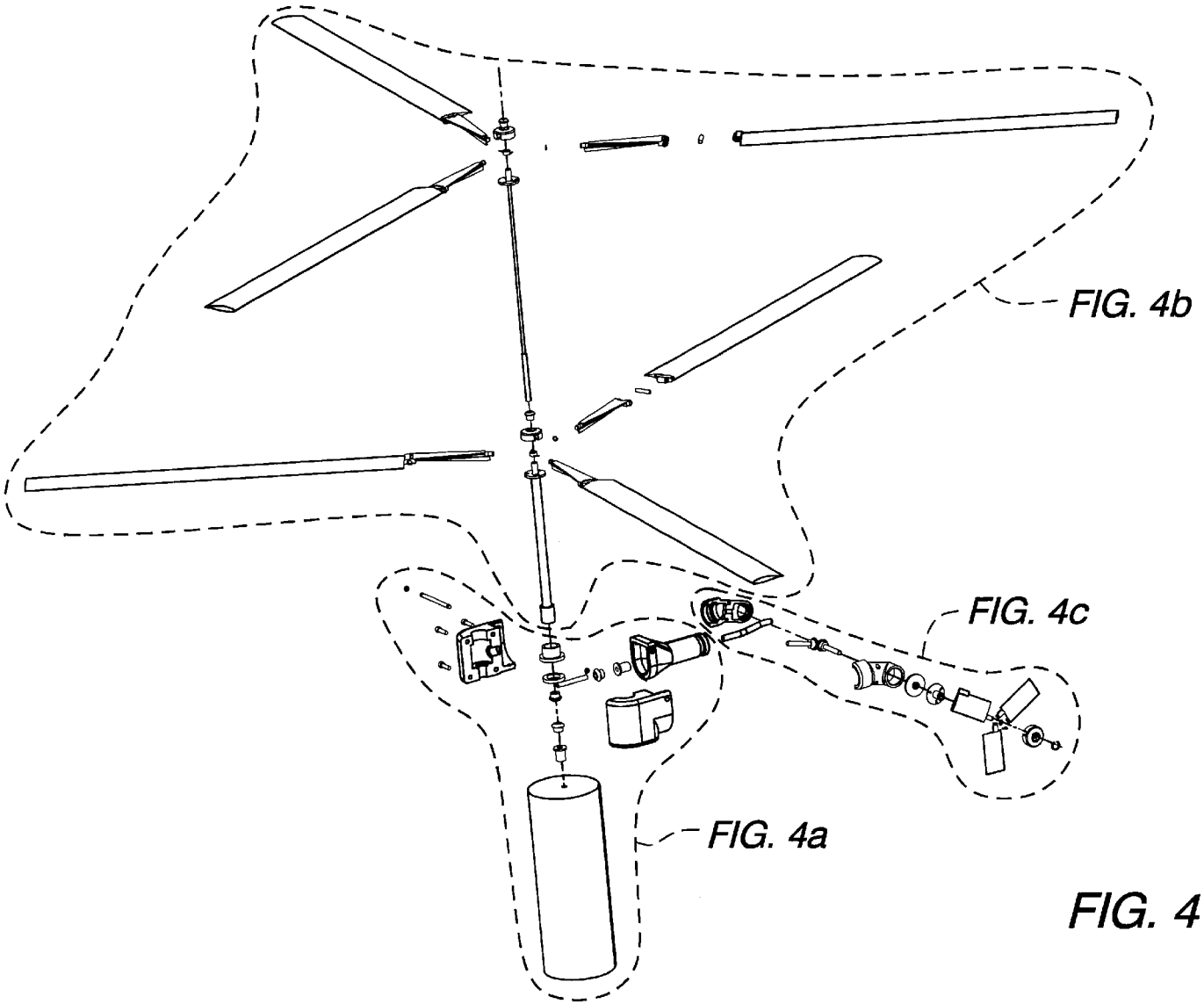
FIG. 4 is an exploded view of the glide and descent mechanism showing major sub assemblies.
Figure 4A:
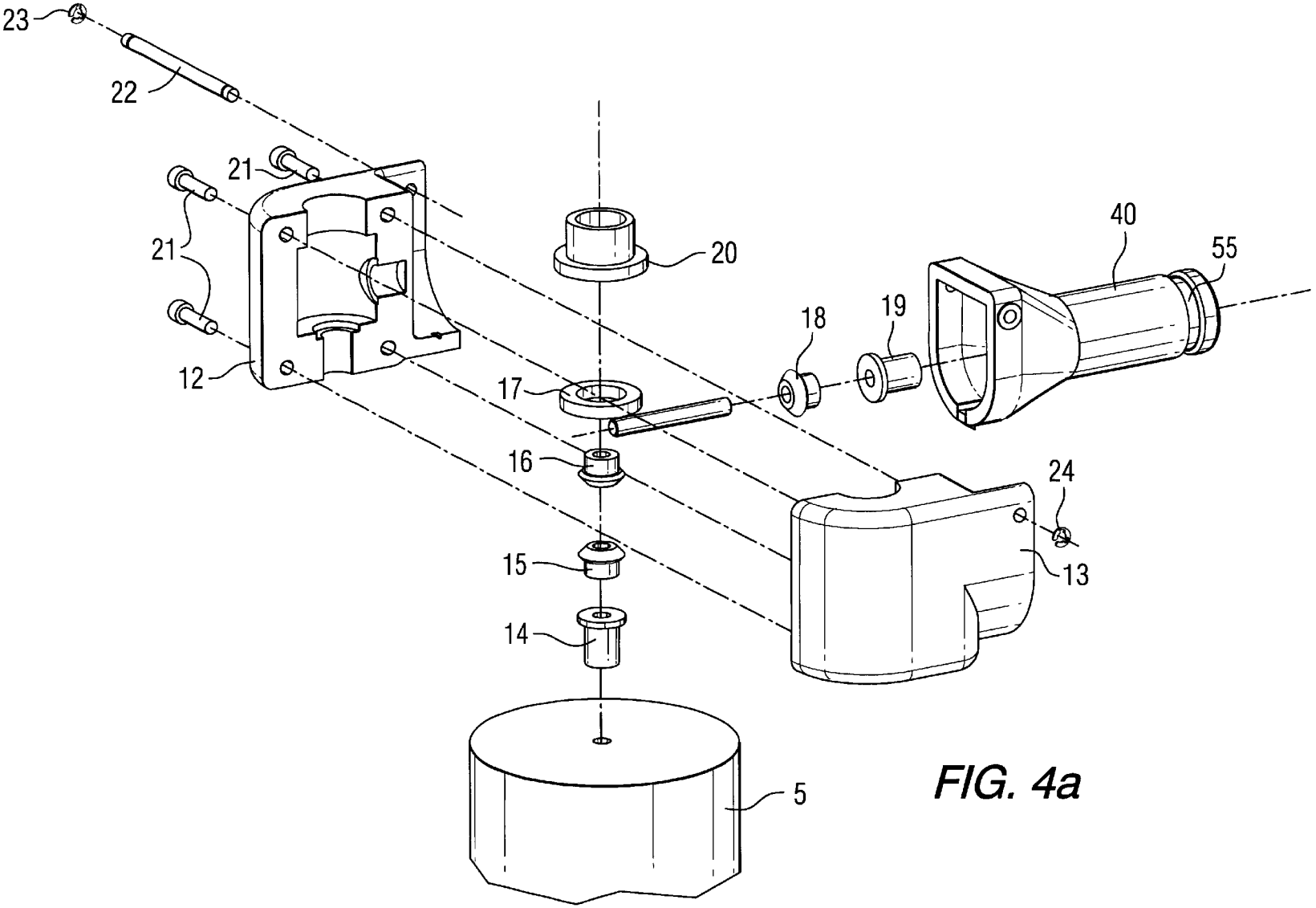
FIG. 4*a* is an exploded view of the major sub assembly showing the components of the drive train mechanism.
Figure 4B:
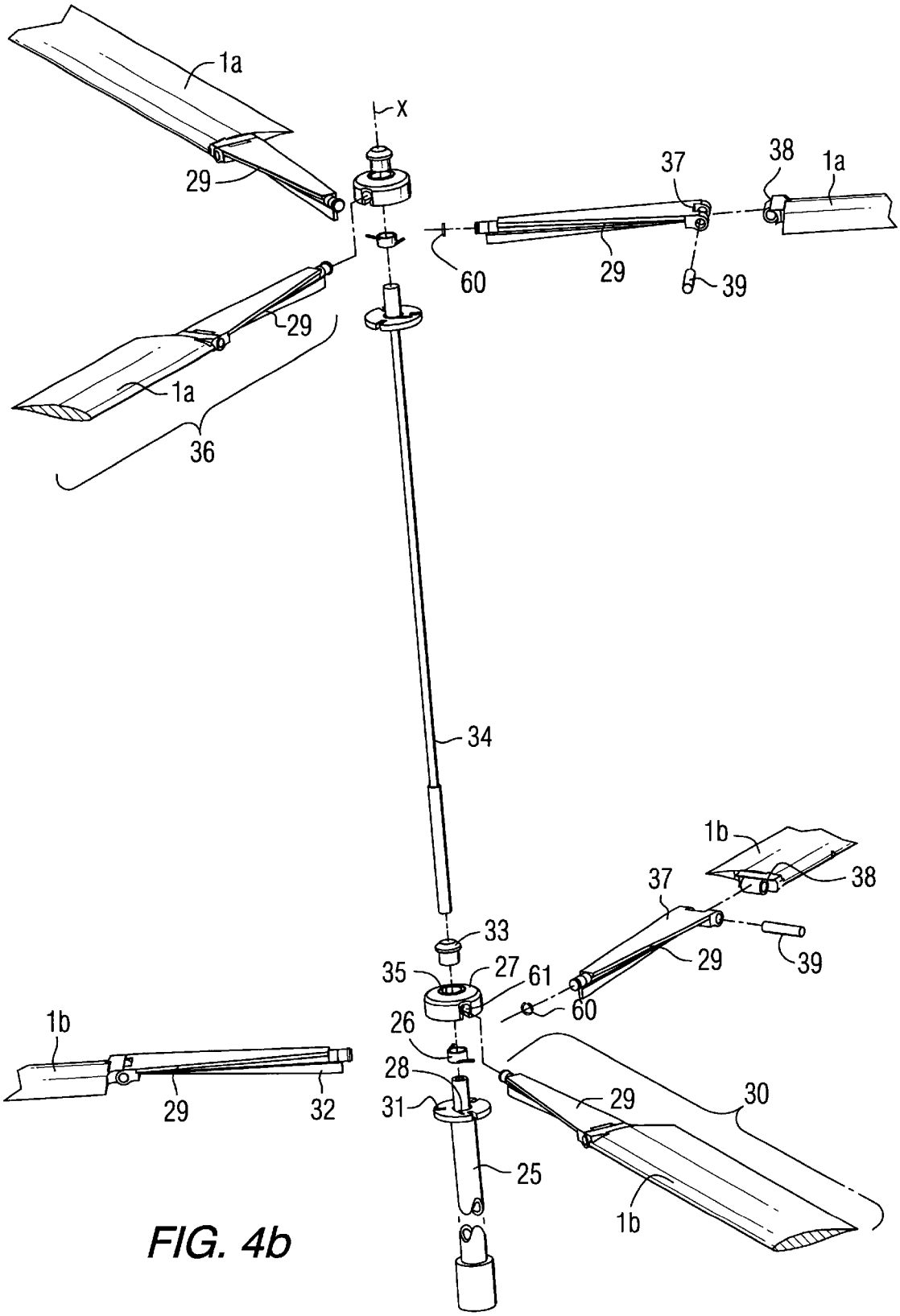
FIG. 4*b* is an exploded view of the major sub assembly showing the components of the counter rotating main rotor blades system.
Figure 4C:
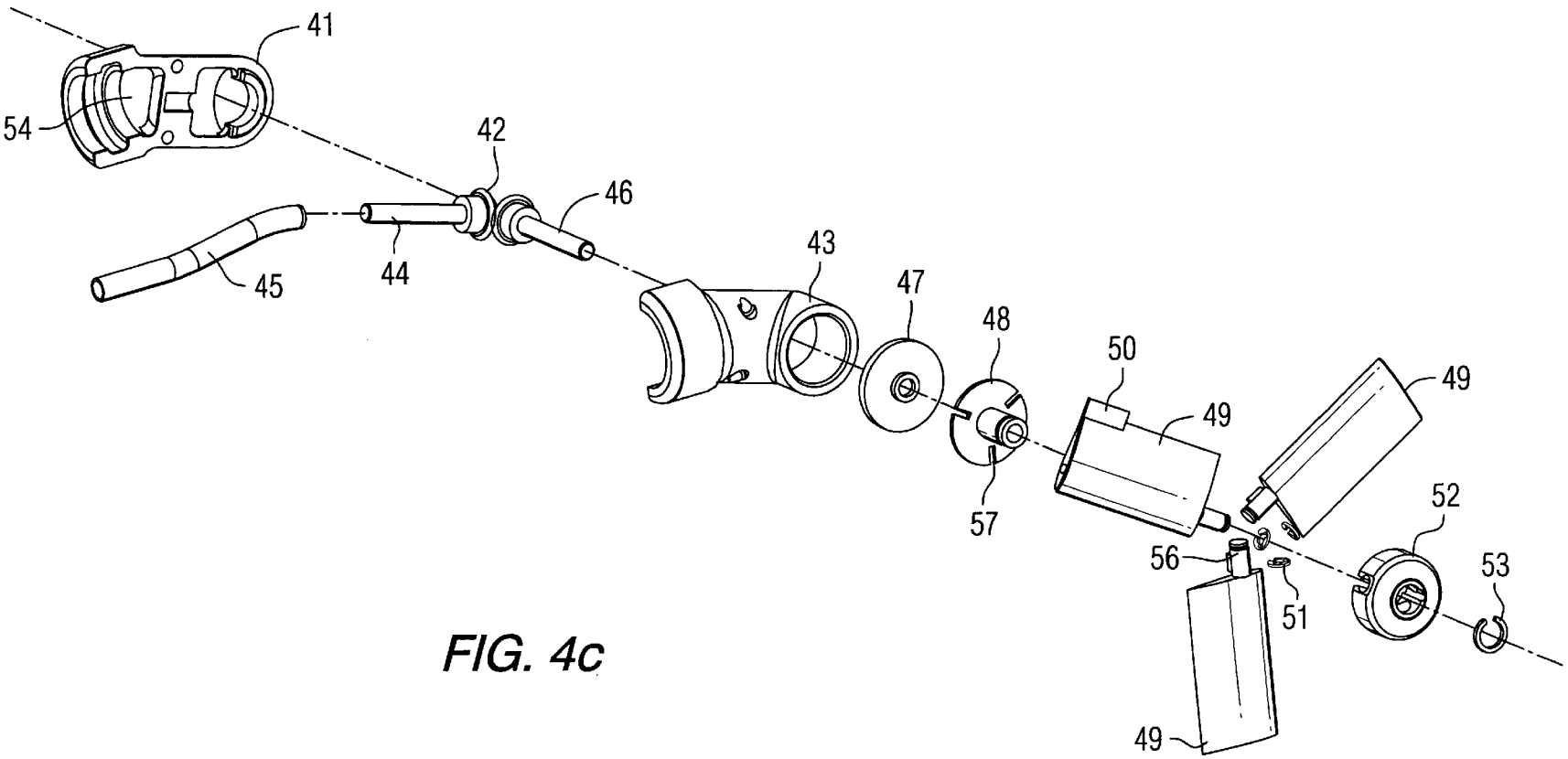
FIG. 4*c* is an exploded view of the major sub assembly showing the components of the tail rotor mechanism.

FIG. 4 is an exploded view of the device (100), illustrating the sub assemblies shown in FIGS. 4*a*, 4*b* and 4*c*.

FIG. 4*a* shows the device drive train sub assembly; (12) transfer case—right side, (13) transfer case—left side, (14) main rotor shaft bushing—lower, (15) miter gear—lower, (16) miter gear—upper, (17) main rotor shaft collar, (18) miter gear—tail rotor, (19) tail rotor shaft bushing, (20) main rotor shaft bushing—upper, (21) transfer case screws, (22) tail boom hinge pin, (23) hinge pin snap ring—right, (24) hinge pin snap ring—left.

FIG. 4*b* shows the invention main rotor sub assembly; (25) main rotor shaft—lower, (26) torque spring—lower, (27) blade hub—lower, (28) torque spring receiver slot, (29) main rotor blade arm, (30) rotor blade assembly—lower, (31) blade pitch control cam slot, (32) blade pitch control cam lever, (33) rotor cap—lower, (34) main rotor shaft—upper, (35) hub torque spring receiver slot, (36) rotor blade assembly—upper, (37) main rotor blade arm hinge stop, (38) main rotor blade hinge stop and (39) main rotor blade hinge pin.

The blade pitch control system for auto-gyration flight is automatically controlled by the torque spring and will be illustrated for the lower blade system, but is consistent with the upper blade system. The spring (26) is located concentric to rotor shaft (25) while connected to both the rotor shaft (25) and the lower blade hub (27). The spring is contained within the torque spring slot (28) on the rotor shaft (25). The spring is designed to assert torque between the hub (27) and the shaft (25) to automatically return the blade pitch angle to the designed angle required for auto-gyration. The blade rotor arm (29) is inserted in the hub (27) through the hub receiver slot (61) and is locked in place by a snap ring (60). This allows the blade rotor arm to pivot within the hub (27). The blade pitch control cam lever (32), a part of the blade rotor arm (29), is inserted in the cam control slot (31) of rotor shaft (25). Rotation of the blade rotor arm within the hub is controlled by the cam control slot and the cam lever. The hub receiver slot (61) acts to limit the pivot angle of the blade rotor arm.

During powered flight, torque from the motor drive (5*d*) is directly applied to the upper main rotor blade shaft (34). Torque is then transferred to the lower main rotor shaft (25), through a gearing arrangement consisting of miter gears (15), (16) and (18). Combined torque from the shaft and aerodynamic drag from the main rotor blades work together to overcome the torque applied by the torque spring, forcing the rotor blade arm to be rotated by the action of the cam slot against the cam lever. The resulting rotation of the rotor blade arm changes the blade pitch angle and thus increases the lift of the blades.

The folding of the main rotor blades, as shown in FIG. 2, is achieved through the main blade hinge components and is illustrated in FIG. 4*b* with the following discussion, but is typical for each of the blades. The folding action is achieved through the attachment of one end of the hinge to the rotor blade arm (29) and the other end of the hinge to the main rotor blade (1*a* ) or (1*b*). The hinge joint is connected by the hinge pin (39). Each blade hinge joint is designed to rotate to achieve the fully folded configuration as seen in FIG. 2. Hinge stops (37) and (38) are designed to restrict blade rotation for the fully deployed blade configuration. The blade stops can be designed to achieve any desired blade dihedral. Torsion springs (not shown) would aid in the unfolding of the blades.

Unfolding of the tail boom (3) from the stowed configuration is accomplished by a torsion spring, or similar means, located within the tail boom. When the tail boom reaches the deployed configuration, a detent locks it in place.

FIG. 4*c* shows the invention tail rotor sub assembly; (40) tail boom housing, (41) tail rotor housing—right, (42) tail rotor miter gear assembly, (43) tail rotor housing—left, (44) tail rotor drive shaft, (45) tail rotor flexible connecting shaft, (46) tail rotor blade shaft, (47) tail rotor housing nacelle cap, (48) tail rotor pitch plate, (49) tail rotor blade, (50) tail rotor blade pitch control tab, (51) tail rotor blade snap ring, (52) tail rotor hub, (53) tail rotor shaft snap ring, (54) tail rotor assembly pivot slot, (55) tail boom housing pivot slot, (56) tail rotor pitch control arm and (57) tail rotor pitch control slot.

The tail rotor blade pitch control is achieved through the use of a simple trim control tab. The action and function of an aerodynamic trim tab are well known to those skilled in the art. For the invention, a single trim tab (50) is used to control the pitch angle of one of the tail rotor blades (49). Deflection of the trim tab (50) may be achieved by use of a piezoelectric bending motor as the trim tab itself, and which is commanded by a signal from the electronics unit (5*b*) by means of electrical leads and slip rings (not shown). The pitch angle is synchronized between each of the tail rotor blades through the cam slots (57), located in the tail rotor pitch plate (48), and the tail rotor pitch control arms (56), which are attached to each of the tail rotor blades (49).

Figure 5:
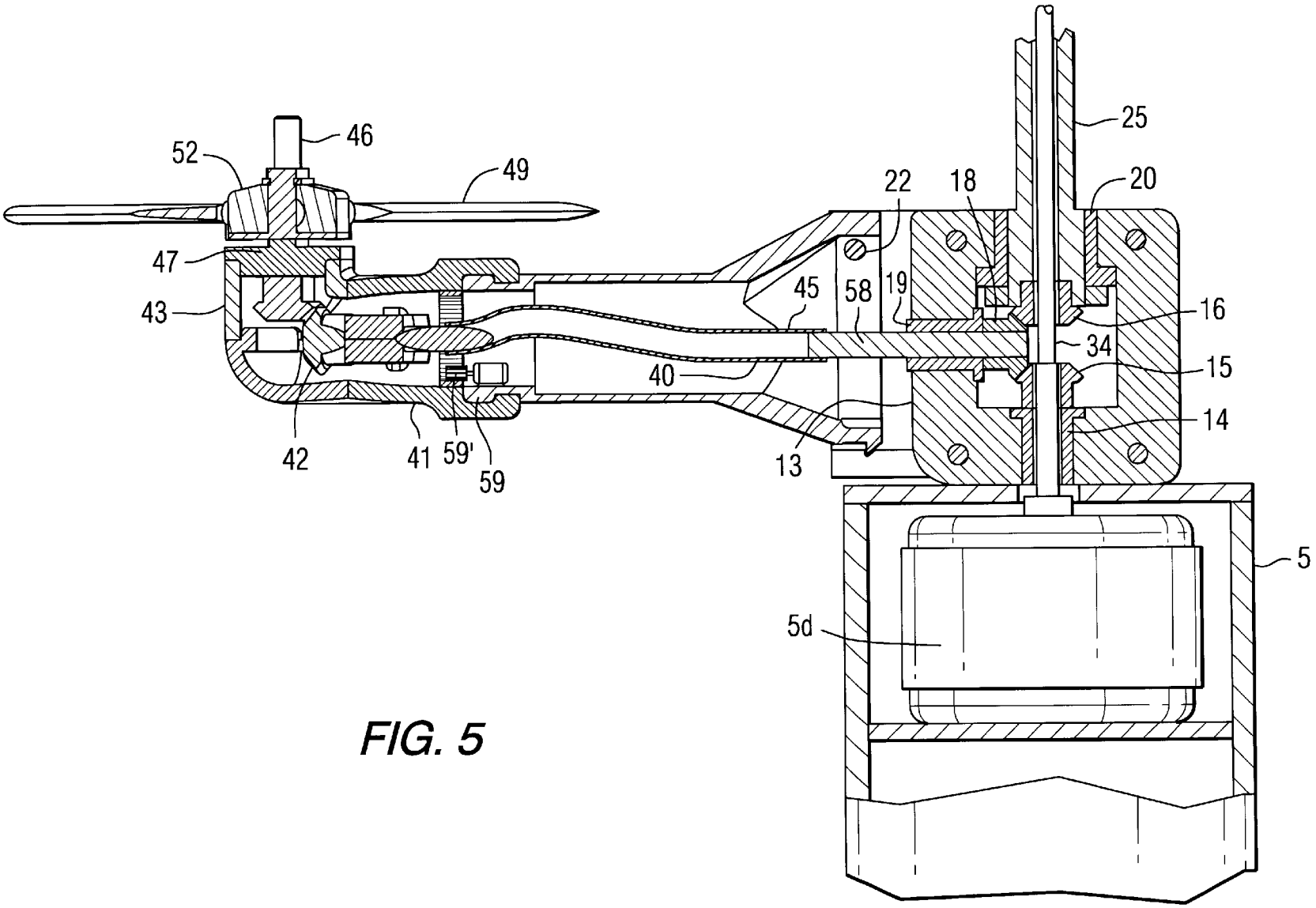
FIG. 5 is a cut-a-way showing details of the drive train mechanism and the tail rotor drive mechanism.

FIG. 5 is a cutaway view of the assembled device drive train; (5) payload and flight control package canister, (14) main rotor shaft bushing—lower, (15) miter gear—lower, (25) main rotor shaft—lower, (13) transfer case—upper, (16) miter gear—upper,(20) main rotor shaft bushing—upper, (34) main rotor shaft—upper, (18) miter gear—tail rotor, (19) tail rotor shaft bushing, (58) tail rotor drive shaft—fore part, (40) tail boom housing, (45) tail rotor flexible connecting shaft, (59) tail rotor pivot joint, (41) tail rotor housing—right, (42) tail rotor miter gear assembly, (43) tail rotor housing left, (47) tail rotor housing nacelle cap, (52) tail rotor hub, (46) tail rotor blade shaft and (49) tail rotor blade.

Directional control, both horizontal and vertical, is achieved through the use of the tail rotor system. During unpowered auto-gyration flight, horizontal maneuvering is obtained by means of the tail rotor system. The tail rotor blades (49) are driven by the rotation of the main rotor blades (1) through the transfer case assembly (2). Through use of the trim tab (50) to control the tail rotor blade pitch, lift is created perpendicular to the tail rotor blades. The lift from the tail rotor can be directed by pivoting the tail rotor assembly (4) about the tail boom assembly (3), that is, by rotation about axis Y by means of motor-driven gearing unit (59') which receives the necessary signals from the electronics unit (5*b*), and causes relative movement of the two parts, (3) and (4), at the slip joint (59). Flight direction is achieved by vectoring the resultant lift to obtain the desired flight control and flight direction.

Likewise, during powered flight directional control of the lift from the tail rotor system can be used to direct the flight of the device for (a) maintaining hover, (b) forward flight, (c) side slip and (d) rearward flight. Since the column of air can be vectored to achieve any combination of lift and side force, it is possible to achieve complete flight control.

Figure 6A:
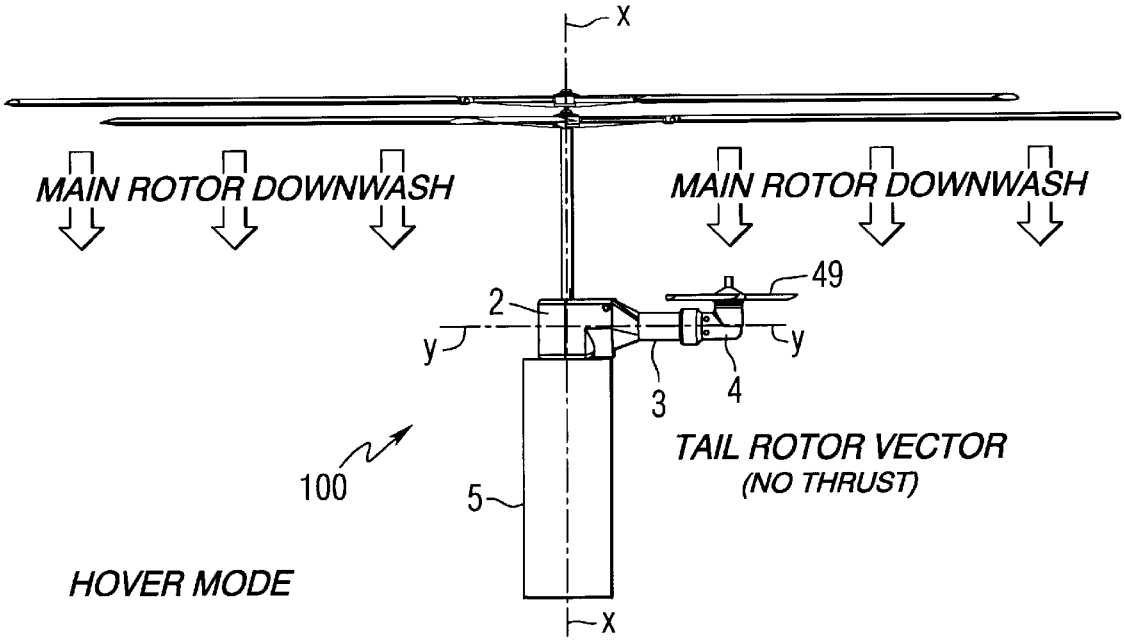
FIG. 6*a* is a view showing the invention as it would be deployed in a hover mode.

By way of example, FIG. 6*a* illustrates the device (100) after deployment. With the main rotor blades (1) counter rotating and with zero pitch assigned to the tail rotor blades (49), the device is vertical and may descend at a controlled rate. If the embodiment of the device includes a motor, the device may also operate in a hover (stationary) mode or ascend vertically.

For controlled lateral movement, the rotor blades (49) are commanded to a certain pitch angle by means of movement of the piezoelectric bender motor, which is the control tab (50). This is illustrated in FIG. 6*b*.

Figure 6B:
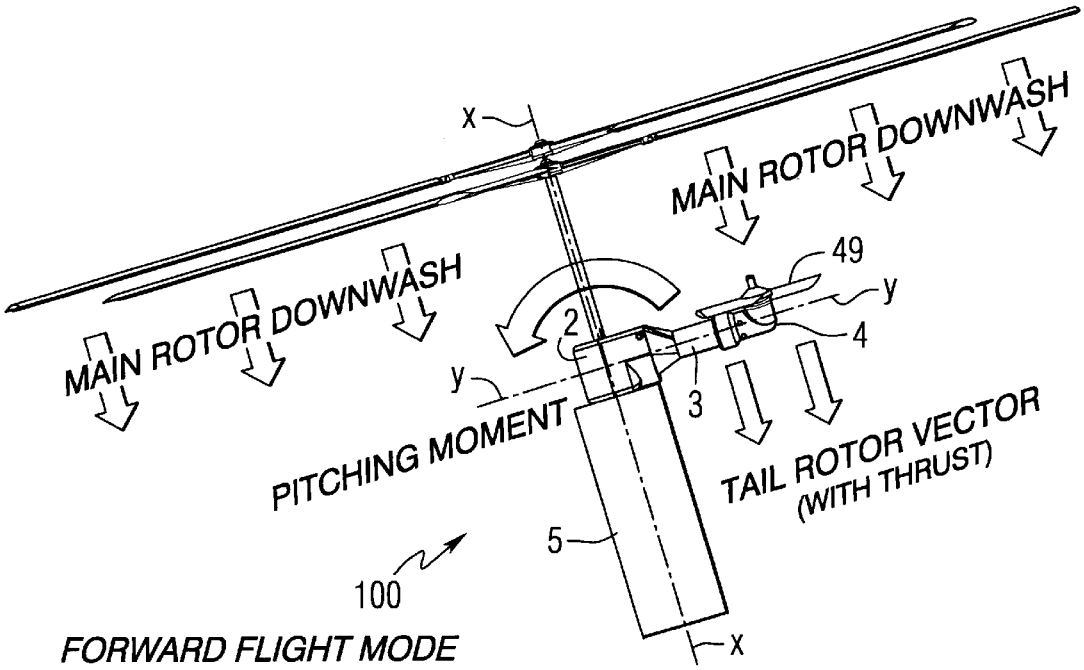
FIG. 6*b* is a view showing the invention as it would be fully deployed in forward flight.

FIG. 6*b* illustrates the effects of the tail rotor thrust vector when thrusting in the direction of the main rotor down wash. The resulting effect causes the device (100) to tilt, with the resulting down wash having both vertical and horizontal lift components. The vertical component provides the lift for the device, while the horizontal component creates forward velocity.

To achieve movement in different directions, the tail boom (3) may be rotated about axis Y by means of motor-driven gearing (59') to assume some intermediate orientation between facing upwards and facing downwards. The resultant summation of all thrust vectors then determines the flight direction.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. For example, the resultant thrust for determining direction of flight may be achieved through use of a series of canister-mounted vanes, or fins, controlled by signals from electronics unit (5*b*). The orientation of these vanes would then selectively direct the main rotor blade down wash to establish lateral directional flight.

It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A gun hardened, rotary winged device adapted to be placed into a carrier projectile which is launched to an area above a remote location and thereafter ejected from the carrier, comprising:

a counter rotating main blade assembly having a plurality of blades which are foldable so as to fit within said carrier and which spring to an operating position after said ejection;

a payload canister;

a shaft assembly connecting said canister with said main blade assembly, said shaft assembly and said canister being collinear and extending along an elongated axis, X;

a tail rotor having a plurality of rotor blades which are adjustable in pitch; means including a tail boom connecting said tail rotor with said canister, said tail boom extending along an axis, Y; and means for collectively adjusting the pitch angle of said tail rotor blades.

2. A device according to claim 1 wherein:

said tail boom is rotatable to a stowed position prior to said launch such that said axis Y is essentially parallel to said axis X and assumes an operating position after said ejection.

3. A device according to claim 1 wherein:

said tail rotor blades are collectively connected to a tail rotor pitch plate; and at least one of said tail rotor blades includes a moveable trim tab, the position of which determines the pitch of said tail rotor blades.

4. A device according to claim 3 wherein:

said trim tab is a piezoelectric bender motor.

5. A device according to claim 4 wherein:

when said device is deployed said axis X is perpendicular to said axis Y.

6. A device according to claim 1 which includes:

a motor for driving said main blade assembly.

7. A device according to claim 6 wherein:

said motor is positioned within said canister.

8. A device according to claim 7 wherein:

said main blade assembly includes upper and lower coaxial blade assemblies; and wherein said shaft assembly is comprised of concentric counter rotating shafts each connected to a respective one of said upper and lower blade assemblies.

9. A device according to claim 8 wherein:

at least one of said concentric shafts is connected to be driven by said motor; and which includes a gearing arrangement for coupling rotation of said one driven concentric shaft to the other said concentric shaft.

10. A device according to claim 9 wherein:

said gearing arrangement is additionally operable to couple said rotation to said tail rotor blades.

11. A device according to claim 10 which includes:

a flexible shaft connected to couple said rotation from said gearing arrangement to said tail rotor blades.

12. A device according to claim 4 wherein:

said tail boom and said tail rotor are coaxially positioned along said axis Y and are rotatable with respect to one another by means of a slip joint; and which includes means for relatively rotating said tail rotor about said axis Y.

13. A device according to claim 12 which additionally includes:

a power unit; and an electronics unit connected to the power unit and connected to control said piezoelectric bender motor and said means for relatively rotating said tail rotor about said axis Y.

* * * * *